United States Patent [19]

Fichte et al.

[11] 4,263,04

[45] Apr. 21, 198

[54] SINTERABLE MASS FOR PRODUCING WORKPIECES OF ALLOY STEEL

[75] Inventors: Rudolf Fichte, Nuremberg; Hans-Joachim Retelsdorf, Weiherhof; Richard Jervis, Stolberg; Günter Radel, Nuremberg, all of Fed. Rep. of Germany

[73] Assignee: GfE Gesellschaft für Elektrometallurgie mit beschränkter Haftung, Düsseldorf, Fed. Rep. of Germany

[21] Appl. No.: 945,900

[22] Filed: Sep. 26, 1978

Related U.S. Application Data

[60] Continuation-in-part of Ser. No. 682,030, Apr. 30, 1976, abandoned, Division of Ser. No. 614,678, Sep. 18, 1975, abandoned.

[30] Foreign Application Priority Data

Sep. 19, 1974 [DE] Fed. Rep. of Germany ..... 2444727

[51] Int. Cl.[3] ..... B22F 1/00

[52] U.S. Cl. ..... 75/252; 75/203; 75/237; 75/241; 75/242; 75/255

[58] Field of Search ..... 75/0.5 AA, 0.5 AB, 0.5 AC, 75/0.5 BA, 0.5 BB, 0.5 BC, 203, 237, 238, 239, 240, 241, 251, 252, 255, 253, 254, 242; 148/11.5 P; 106/43, 56

[56] References Cited

U.S. PATENT DOCUMENTS 3,655,365 4/1972 Holtz, Jr. ..... 148/11.5 P 3,746,518 7/1973 Holtz, Jr. ..... 75/0.5 B.

3,982,924 8/1973 Perfect ..... 75/0.5 B.

FOREIGN PATENT DOCUMENTS 2444727 11/1975 Fed. Rep. of Germany .

165837 10/1958 Sweden .

OTHER PUBLICATIONS

Translation of Swedish Patent No. 165,837.

*Primary Examiner*—Michael L. Lewis

*Attorney, Agent, or Firm*—Karl F. Ross

[57] ABSTRACT

A workpiece of alloy steel is produced by sinterin under a nonoxidizing atmosphere a mass of malleabl iron powder admixed with a comminuted complex fe roalloy. The latter, obtained from a molten mixture ( several simple high-carbon ferroalloys saturated wit graphite, is a blend of at least three nonferrous meta and iron in carbide form, including a complex carbide ( formula $M_7C_3$ containing iron and manganese with tl possible addition of chromium and another carbide ( formula $M'_2C/M'C$ containing molybdenum with tl possible addition of vanadium and/or niobium. Tl carbidically bound carbon amounts to at least 4%, b weight, of the ferroalloy composition and may const tute between 10% and 60% of the carbon of the sinter ble powder mixture to which elemental carbon may b added as graphite. As the mass of iron and ferroallc particles compacted under high pressure is sintered temperatures between about 1150° and 1300° C., tl carbides lose their identity as their metals diffuse in the soft iron along with the carbon.

3 Claims, No Drawings

Saturation, in this context, means the conversion of substantially all the nonferrous bath metals into the aforedescribed high-carbon carbides.

We prefer to apportion the constituent ferroalloys for the bath in such a way that the proportions of iron, manganese, molybdenum and further nonferrous metal or combination of metals (chromium, vanadium and/or niobium) are within about 10%, by weight, from one another, with the manganese, molybdenum and further nonferrous metal (or metal combination) each accounting for 20 to 25% of the total.

During the hardening of the carbon-saturated melt into a solid body, the stable carbide (which may be in the form of mixed crystals) precipitate first, leaving a residual phase which is rich in iron and also contains carbon as well as the usual impurities, especially silicon. The precipitated carbides are highly comminuted, which facilitates their diffusion into the surrounding iron matrix during the subsequent sintering operation when the residual phase is remelted. This residual phase constitutes substantially less than one fourth, by weight, of the complex ferroalloy.

The carbidically bound carbon of the complex ferroalloy may constitute between about 10 and 60%, by weight, of the total carbon content of the sinterable mass, the remainder being added in graphite form to that mass.

Typical but nonlimitative examples of ferroalloys according to our invention and sintering processes based on these ferroalloys will now be given (all percentages by weight).

EXAMPLE I

A workpiece to be produced, e.g. a cogwheel, is to consist of sintered steel containing significant quantities of manganese and chromium as well as molybdenum as alloying elements. For this purpose we admix commercially available iron powder with a finely comminuted complex ferroalloy (produced as described hereinafer) in a weight ratio of 96% to 4%, the composition of the ferroalloy being 22.7% Mn, 23.6% Cr, 22.4% Mo and 6.85% C, balance iron and normal metallurgical impurities including 0.85% Si. The carbon bound in the ferroalloy composition amounts to roughly 0.3% of the entire mass and may be supplemeneted by up to about 0.3% of graphite. The mass, upon being compacted under a pressure of about 500 $MN/m^2$ to a body having the shape of the desired workpiece, is sintered in a protective atmosphere of split ammonia gas at a temperature of 1250° C. in a conventional furnace equipped, for example, with a ram-supported press bed.

In order to obtain the complex ferroalloy, the following starting materials are melted in a vacuum induction furnace:

| | QUANTITY (parts by weight) | | | | | | |
|---|---|---|---|---|---|---|---|
| | total | Mn | Cr | Mo | Si | C | Fe + residual impurities |
| Ferromanganese | 9.6 | 7.4 | — | — | 0.055 | 0.653 | 1.492 |
| Ferrochrome | 11.0 | — | 7.392 | — | 0.059 | 0.605 | 2.944 |
| Ferromolybdenum | 10.2 | — | — | 7.19 | 0.144 | — | 2.866 |
| Graphite Granules | 1.2 | — | — | — | — | 1.200 | — |
| Overall amount | 32.0 | 7.4 | 7.392 | 7.19 | 0.258 | 2.458 | 7.302 |

-continued

| | QUANTITY (parts by weight) | | | | | | |
|---|---|---|---|---|---|---|---|
| | total | Mn | Cr | Mo | Si | C | Fe + residual impurities |
| Theoretical distribution (%) | | 23.1 | 23.1 | 22.5 | 0.8 | 7.7 | 22.8 |

The graphite granules are added to the hot melt, the heat being maintained until they have been fully dissolved therein. The composition is then cooled to a temperature slightly above its melting point (1450° C.) and poured into a mold. After comminution to a mean particle size of 6.5$\mu$, the dried powder is found to have a gas content of 0.2% O and 0.45 milliliter $H_2$ per 100 grams. The actual composition, given above, differs slightly from the theoretical distribution listed in the foregoing table.

The proportions of the starting materials may be modified as long as the composition of the complex ferroalloy stays within the preferred limits of about 20–25% manganese, 20–25% chromium, 20–25% molybdenum, 6–8% carbon, balance iron, silicon and other impurities. Thus, the nonferrous metals of the constituent ferroalloys may each account for approximately one fifth to one fourth of the metal bath; in this specific Example, the amounts of manganese, chromium, molybdenum and iron differ by only a few percentage points from one another.

Upon sintering, the comminuted metal carbides do not oxidize up to 1200° C. and diffuse readily, beginning at about 1100° C., into the surrounding iron particles. The diffusion process is complete upon attainment of the maximum sintering temperature of 1250° C. and, as established by microprobe tests, results in a homogeneous distribution of manganese, chromium and molybdenum in elemental form throughout the mass.

The resulting workpiece has a mechanical strength superior to that of sintered structures of similar composition produced by conventional techniques.

EXAMPLE II

The workpiece to be produced is to consist of alloy steel containing manganese, vanadium and molybdenum. The mass to be sintered consists essentially of 97% commercial soft-iron powder admixed with 3% of a particulate ferroalloy, of composition 23.2% Mn, 24.5% V, 23.8% Mo, 5.3% C, balance iron plus impurities including 1.1% Si with some admixture of elemental carbon as in Example I.

The starting materials to be melted in a furnace, as in the preceding Example, are chosen as follows:

| | QUANTITY (parts by weight) | | | | | | |
|---|---|---|---|---|---|---|---|
| | total | Mn | V | Mo | Si | C | Fe + residual impurities |
| Ferromanganese | 7.70 | 5.98 | — | — | 0.05 | 0.54 | 1.13 |
| Ferrovanadium | 7.30 | — | 5.99 | — | — | — | 1.31 |
| Ferromolybdenum | 8.32 | — | — | 5.98 | — | — | 2.34 |
| Iron and Ferrosilicon | 1.10 | — | — | — | 0.10 | — | 1.00 |
| Graphite | | | | | | | |

SINTERABLE MASS FOR PRODUCING WORKPIECES OF ALLOY STEEL

CROSS-REFERENCE TO RELATED APPLICATIONS

This is a continuation-in-part of our copending application Ser. No. 682,030 filed Apr. 30, 1976 as a division of application Ser. No. 614,678 filed Sept. 18, 1975, both now abandoned.

FIELD OF THE INVENTION

Our present invention relates to the manufacture of sintered workpieces of alloy steel from a mixture of finely comminuted soft-iron and ferroalloy particles.

BACKGROUND OF THE INVENTION

It is known to produce sintered workpieces from a mass of fine particles consisting in a major proportion of soft (ductile or malleable) iron and in a minor proportion of one or more ferroalloys, with admixture of elemental carbon (usually in the form of graphite) to the extent required in the steel which results from the sintering process. In some instances, especially in the case of tool or high-speed steels which characteristically contain various carbides, the ferroalloy particles are produced separately from the soft iron as a mixture of comminuted iron carbide with the comminuted carbides of several non-ferrous metals, e.g. chromium, tungsten, vanadium and molybdenum along with titanium, tantalum and/or niobium. Typical compositions of such ferroalloys, in which the aforementioned nonferrous metals as well as iron are present as individual carbides, contain carbon up to 15%, chromium from 5% to 30%, tungsten up to 35%, vanadium up to 25%, molybdenum up to 30%, and up to 15% of each of the other elements referred to, balance iron and the usual metallurgical impurities present in the melt from which these carbides are obtained; the iron, as a rule, amounts to substantially less than 50% (by weight) of the composition. Such a mixture can be comminuted mechanically, i.e. by grinding, or by a hot spray. The ferroalloy carbides retain their identity in the subsequent sintering operation.

For other types of alloy steel, particularly those including manganese, it has been the practice to blend the iron with its nonferrous additives directly in the melt whose composition therefore corresponds to that of the final product. A diadvantage of this method is the unavoidable oxidation of the metals, especially manganese and chromium, the oxygen content of the steel impairing the mechanical properties of the resulting workpieces. Furthermore, the production of workpieces of reasonable strength from such compositions requires the use of compacting pressures which exceed by a factor of 2 the pressure normally employed in the powder metallurgy of iron. Attempts to produce satisfactory alloy steels containing manganese, molybdenum, chromium, vanadium and/or niobium by this technique have been particularly unsuccessful.

It has also been proposed to form a sinterable mass by admixing complex carbides of nonferrous metals, e.g. chromium and manganese, with iron powder. These carbides have a relatively low carbon content and their metallic constituents are prone to oxidation prior to sintering, a process which is not easily reversible even when sintering is carried out in a protective atmosphere including a getter.

OBJECTS OF THE INVENTION

An object of our present invention, therefore, is to provide an improved metallic mass for making workpieces of alloy steel containing substantial proportions of manganese and molybdenum, plus chromium, vanadium and/or niobium, this mass being moldable with the usual sintering equipment into structures of great strength and density.

A related object is to provide a process for producing a complex ferroalloy forming part of such a sinterable mass.

SUMMARY OF THE INVENTION

In accordance with our present invention we produce a comminuted complex ferroalloy consisting essentially of a powdered solid-state blend of carbides of iron and several non-ferrous metals, namely manganese and molybdenum, in combination with chromium, vanadium and/or niobium; the carbides are of the form $M_7C_3$, where M represents the metals iron, vanadium and possibly chromium, and $M'_2C/M'C$, where M' includes molybdenum with the possible addition of vanadium and/or niobium. Preferably, the carbidically bound carbon accounts for at least 4% by weight of the complex ferroalloy. Upon comminution of that ferroalloy, advantageously to a particle size of less than 10 microns, the ferroalloy particles are admixed in a minor proportion (about 0.5 to 5%) with a major proportion of malleable-iron powder to form a sinterable mass which is then compacted under high pressure into a body conforming to the shape of the workpiece to be produced by sintering at a temperature ranging substantially between 1150° C. and 1300° C., preferably not more than 1280° C. The compacting pressure may be on the order of several hundreds of meganewtons per square meter as is usual in the sintering of ferrous metals. Such a complex ferroalloy composition generally has an oxygen content of about 0.2% by weight.

We have found that such a mass is highly resistant to oxidation, at temperatures up to or above 1200° C., despite the presence of substantial quantities of manganese (e.g. about 20% to 35% by weight of the ferroalloy composition) and possibly chromium, two metals that are ordinarily prone to oxidation. Surprisingly enough, and contrary to what happens in the production of sintered workpieces of tool or high-speed steels, the carbide or carbides in the composition lose their identity during sintering as their nonferrous metals and the carbon diffuse into the elemental iron; we attribute this to the absence of oxides of manganese and chromium in the complex ferroalloy as well as to the process used in making the composition.

This process involves, pursuant to another aspect of our invention, the joint melting of several simple ferroalloys of the high-carbon type containing iron, manganese, molybdenum and the other nonferrous metal or metals required for the final product, with the addition of sufficient elemental carbon (e.g. in the form of graphite granules) to saturate the melt upon being dissolved therein. After the molten composition has hardened, it is disintegrated and ground to the aforementioned particle size of less than 10 microns; the final grinding step may be carried out in a nonaqueous liquid, e.g. gasoline or decahydronaphthalene, with the aid of an attrition mill such as a Fisher Sub-Sieve Sizer.

-continued

| | QUANTITY (parts by weight) | | | | | | |
|---|---|---|---|---|---|---|---|
| | total | Mn | V | Mo | Si | C | Fe + residual impurities |
| Granules 0.90 | — | — | — | — | 0.90 | — | |
| Overall amount | 25.32 | 5.98 | 5.99 | 5.98 | 0.15 | 1.44 | 5.78 |
| Theoretical distribution (%) | | 23.6 | 23.7 | 23.6 | 0.6 | 5.7 | 22.8 |

The procedure is the same as before. Again, the actual composition given above differs somewhat from the listed theoretical distribution. The gas content is 0.15% O and 60 ml $H_2$ per 100 g.

The ferrovanadium may be replaced, entirely or in part, by ferroniobium. The recommended limits for the proportions of the constituents of a complex ferroalloy of this type are about 20–25% manganese, 20–25% vanadium and/or niobium, 20–25% molybdenum, 4–8% (preferably up to 7%) carbon, balance iron, silicon and other impurities. Here, too, the nonferrous metals manganese, molybdenum and vanadium/niobium may each account for approximately one fifth to one fourth of the metal bath, their amounts again differing from one another and from that of iron by only a few percentage points in the specific Example given.

Upon compaction, at a pressure of 500 $MN/m^2$ as in the preceding Example, the metallic body is sintered in a protective atmosphere of split ammonia gas at 1280° C. Again, no oxidation occurs up to 1200° C. Microprobe tests show a very uniform distribution of manganese, molybdenum and vanadium in the sintered steel whose mechanical properties even surpass those of the steel obtained according to Example I.

We claim:

1. A sinterable mass to be used in the manufacture c workpieces of alloy steel, said mass being essentiall composed of a major proportion of malleable-iron pow der, a minor proportion of comminuted complex ferr alloy compositions highly resistant to oxidation at ten peratures up to at least 1200° C., said minor proportio ranging between substantially 0.5% and 5% by weigh of said mass, and about 0.2 to 0.6 weight-percent el mental carbon; said ferroalloy composition consistin essentially of a powdered solid blend, with a particl size below 10 microns, of carbides of iron, manganes molybdenum and at least one further nonferrous met plus a residual phase consisting mainly of iron, sai further nonferrous metal being selected from the grou which consist of chromium, vanadium and niobiun said carbides including a complex carbide of the fo mula $M_7C_3$ wherein M is a combination of iron wit either manganese or chromium plus manganese, th carbon carbidically bound in said ferroalloy compos tion amounting to at least 4% by weight of said compc sition.

2. A sinterable mass as defined in claim 1 wherein sai ferroalloy composition consists essentially, in percer by weight, of 20–25% Mn
20–25% Cr
20–25% Mo
6–8% C
balance iron and metallurgical impurities.

3. A sinterable mass as defined in claim 1 wherein sai ferroalloy composition consists essentially, in percer by weight, of 20–25% Mo
20≧25% of at least one metal selected from th group which consists of Va and Nb
20–25% Mn
up to 7% C
balance iron and metallurgical impurities.

* * * * *